US011629939B2

(12) United States Patent
Wilkins

(10) Patent No.: US 11,629,939 B2
(45) Date of Patent: Apr. 18, 2023

(54) OPTO-THERMAL LASER DETONATOR

(71) Applicant: LAWRENCE LIVERMORE NATIONAL SECURITY, LLC, Livermore, CA (US)

(72) Inventor: Paul R. Wilkins, Oakland, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

(21) Appl. No.: 17/460,717

(22) Filed: Aug. 30, 2021

(65) Prior Publication Data

US 2022/0120538 A1 Apr. 21, 2022

Related U.S. Application Data

(62) Division of application No. 15/882,172, filed on Jan. 29, 2018, now Pat. No. 11,131,530.

(51) Int. Cl.
*F42B 3/113* (2006.01)
*F42B 3/11* (2006.01)

(52) U.S. Cl.
CPC ..... *F42B 3/113* (2013.01); *F42B 3/11* (2013.01)

(58) Field of Classification Search
None
See application file for complete search history.

(56) References Cited

U.S. PATENT DOCUMENTS 3,724,383 A 4/1973 Gallaghan et al.
3,812,783 A 5/1974 Yang et al.
5,101,727 A 4/1992 Yarrington
6,460,459 B1 10/2002 McCahon et al.
6,487,971 B1 12/2002 Anderson
6,499,404 B1 12/2002 Kern et al.
7,479,494 B2 1/2009 Chen et al.
8,915,188 B2 12/2014 Le Breton et al.
9,829,289 B1 11/2017 Burke
(Continued)

FOREIGN PATENT DOCUMENTS

EP 1 443297 A1 1/2004
EP 2 142 877 B1 1/2016

OTHER PUBLICATIONS

Optical sensitisation of energetic crystals with gold nanoparticles for laser ignition, Combustion and Flame, XiaoFang MishminderSharma ChristopherStennett PhilipP.Gil, May 18, 2017 (Year: 2017).*
(Continued)

*Primary Examiner* — Aileen B Felton
(74) *Attorney, Agent, or Firm* — Eddie E. Scott

(57) ABSTRACT

An opto-thermal laser detonator uses resonantly absorptive tuned nano-material associated with secondary explosives for optical absorption and initiation by an integral laser diode. The opto-thermal laser detonator includes main explosive material; resonantly absorptive tuned nano-material; secondary explosive material, wherein the resonantly absorptive tuned nano-material and the secondary explosive material are associated to form associated material made of the resonantly absorptive tuned nano-material and the secondary explosive material; and a laser diode operatively connected to the associated material, wherein the laser diode initiates the associated material which in turn initiates the main explosive material.

4 Claims, 4 Drawing Sheets

(56) References Cited

U.S. PATENT DOCUMENTS

| | | | | |
|---|---|---|---|---|
| 11,131,530 | B2 | 9/2021 | Wilkins | |
| 2010/0180789 | A1* | 7/2010 | Paesch | F42B 7/08 102/522 |

OTHER PUBLICATIONS

Laser-Induced Reshaping of Metallodielectric Nanoshells under Femtosecond and Nanosecond Plasmon Resonant Illumination, J. Phys. Chem. B 2004, 108, 7040-7045, Carla M. Aguirre,† Cristin E. Moran,‡ James F. Young,§ and Naomi J. Halas, Mar. 2, 2004 (Year: 2004).*

Aguirre et al., "Laser-Induced Reshaping of Metallodielectric Nanoshells under Femtosecond and Nanosecond Plasmon Resonant Illumination," J. Phys. Chem. B, 2004, 108, pp. 7040-7045.

Fang et al, "Optical sensitisation of energetic crystals with gold nanoparticles for laser ignition," Combustion and Flame, 2017, pp. 15-21.

International Search Report and Written Opinion for PCT/US2019/015717, corresponding to U.S. Appl. No. 15/882,172, 11 pages.

* cited by examiner

OPTO-THERMAL LASER DETONATOR

CROSS-REFERENCE TO RELATED APPLICATIONS

The present application is a Division of application Ser. No. 15/882,172 filed Jan. 29, 2018 entitled "OPTO-THERMAL LASER DETONATOR," the disclosure of which is hereby incorporated by reference in its entirety for all purposes.

STATEMENT AS TO RIGHTS TO APPLICATIONS MADE UNDER FEDERALLY SPONSORED RESEARCH AND DEVELOPMENT

The This invention was made with Government support under Contract No. DE-AC52-07NA27344 awarded by the United States Department of Energy. The Government has certain rights in the invention.

BACKGROUND

Field of Endeavor

The present application relates to detonators and more particularly to an opto-thermal laser detonator.

State of Technology

This section provides background information related to the present disclosure which is not necessarily prior art.

Optical laser detonators in the past have either used very high peak power lasers (q-switched) to vaporize a metal film into a plasma that shocks a low density pressing of a secondary explosive such as PETN or they have mixed carbon black, or Single Walled Nanotubes (SWNT), or absorptive dyes with the secondary explosive to cause absorption of laser light as most explosives are white and simply lightly scatter, but do not absorb laser light. The technical problem of using dyes mixed with explosive is that they saturate after absorbing a certain amount of energy and become transparent to the radiation, plus the nanoshells at the defined concentration has an absorption cross section approximately one million times higher than a standard NIR absorbing dye such as indocyanine green, the SWNT and the carbon black are simply black absorbing materials that are not resonant absorbers and therefore only have a certain absorbance related to their percentage of the explosive mixture and have a cross section that can only be increased by adding them in appreciable quantities (a few percent) compared to the nanoshells or nanorods (parts per thousand). As the percentage of carbon black or SWNT increases over a few percent, the energy to initiate the mixture drops and the explosive properties of the mixture are diminished. The total mass of the nanomaterial used in this invention solves both the volume additive problem as they are individually just picograms in total weight and add a total mass of a few milligrams for each gram of explosive at the highest concentration of hundreds of billions of nanoshells or nanorods per gram of explosive. The discrete nature of the nanoshells or nanorods helps them to act as discrete 'hot spots' that aid in the transition to detonation in the high distribution of them throughout the critical absorbing volume of explosive that thermally initiates into an explosive, replicating the shock induced 'hot spot' formation from shock assisted detonation used in conventionally slapper initiated explosives in practice used by industry and DOD and DOE applications. The nanoshells or nanorods don't photo-saturate and become transparent as a laser dye would and continues to absorb laser light and convert it to heat until the nanoshell heats to a temperature where the metal layer melts, well above the thermal runaway temperature of all explosives.

Additionally, the nanoshells or nanorods are of such small dimensions that the free electrons in the metals used are in layered atomically perfect layers and undergo ballistic electron transport without the normal scattering from defects in a bulk metal and therefore react to surface plasmons as resonance with the specific geometry at the diode laser wavelength at the speed of the frequency of light and heat up at tremendous rates undergoing thermal changes in the sub-nanosecond timeframe. This rapid heating rate associated with plasmonic nanoresonant structures that are distributed volumetrically in the explosive allows for rapid volumetric heating not limited by thermal conduction of the explosive and allowing for very rapid deflagration of the explosive into a detonation. The nanoshells or nanorods are made of inert chemically nonreactive materials such as gold or possibly platinum, in this incarnation as a shell of gold over a sphere of silica, or a hollow shell of gold, or a long aspect ratio of gold several nanometers in length and chemical compatibility and safety tests with the explosives have shown that the chemical reactivity of the mixtures, the spark and friction sensitivity, and the drop hammer height, and the DSC temperature is no different than the original explosives without the additives. The nanoshells or nanorods should be very stable with time and with the normal operating temperature of the typical commercial and military detonators. This laser detonator is unique in this application of the art as it has the laser diode integrated directly into the package with an integral lens to focus the light, but optically isolates the nano-resonantly doped secondary HE from the electrical leads of the laser diode, rendering it electrostatically isolated with the HE in a faraday cage, but optically coupled to the output facet of the laser diode. The low electrical wattage diode itself cannot be turned on by an electrostatic discharge from a person to the point of initiating the secondary explosive so as to make the detonator much more electrically safer than those utilizing primary explosive such as azides or styphnates. The unique use of safer secondary explosives, doped with a unique laser tuned nanoresonant material that heats very quickly combined with a low wattage laser diode creates a low energy detonator that is electrically safer than traditional blasting caps. This is advantageous to high peak power safe detonators such as Exploding Bridgewire (EBW) detonators or slapper detonators as specialized firesets to provide peak powers of hundreds or thousands of amperes are not needed, just a simple DC source at a few volts with several amps of power pulsed for a millisecond time durations.

SUMMARY

Features and advantages of the disclosed apparatus, systems, and methods will become apparent from the following description. Applicant is providing this description, which includes drawings and examples of specific embodiments, to give a broad representation of the apparatus, systems, and methods. Various changes and modifications within the spirit and scope of the application will become apparent to those skilled in the art from this description and by practice of the apparatus, systems, and methods. The scope of the apparatus, systems, and methods is not intended to be limited to the particular forms disclosed and the application covers all modifications, equivalents, and alternatives falling within the spirit and scope of the apparatus, systems, and methods as defined by the claims.

The inventor's apparatus, systems, and methods provide an opto-thermal laser detonator that uses resonantly absorptive tuned nano-material associated with secondary explosives for optical absorption and initiation by an integral laser diode. The inventor's apparatus, systems, and methods have use in low power optical detonators for use in a high RF or microwave field or within a magnetic flux-compression device where high dynamic magnetic fields would Influence electrical detonators. The inventor's apparatus, systems, and methods provide an electromagnetic field safe optical Initiator for weapons stores hung on an airframe exposed to high intensity microwave radar fields or electronic countermeasure generating equipment that is connected via a shielded cable that requires a certain minimum power, and pulse duration. Sufficiently long low-power applied to the laser diode integral in with the inventor's optical detonator can also cause a medium-jitter Initiation suitable for oil well perforator shots, mining, blasting, and non-critical HE applications using safer secondary explosives in lieu of sensitive primary explosives in conventional blasting caps. Low power operation in this detonator can allow for a very low energy laser source (1-watt) to initiate a detonator in a millisecond to hundreds of microsecond time regime where energy conservation is at a premium, the use of secondary explosive and current and power requirements greater than 0.1 Joule to make a static safe optically isolated electro-explosive device (EEO) with low energy requirements. Most low energy detonators in the commercial market use sensitive primary explosives that have a greater static sensitivity which this invention replaces with a specially doped secondary explosive optically isolated from the electric input of the laser diode.

The inventor's apparatus, systems, and methods also have commercial and other uses or possibilities for use. For example, the inventor's apparatus, systems, and methods provide an electrically and radio frequency electromagnet field safe detonator for use in mining, oil exploration, oil well perforator initiation, mining and excavation, civilian demolition, for low precision detonation, low-energy operation, or weapon/rocket motor initiator for military and aerospace contractors in such devices as explosive bolts, linear cutting charges, or stage separation charges in aerospace systems. Several commercial applications for testing and detonation of explosives at outdoor sites or facilities subject to high thunderstorm or lightning activity conditions can reduce the probability of accidental initiation by these much safer secondary explosives in an optically Isolated device that prevents electrostatic initiation of the explosive.

The apparatus, systems, and methods are susceptible to modifications and alternative forms. Specific embodiments are shown by way of example. It is to be understood that the apparatus, systems, and methods are not limited to the particular forms disclosed. The apparatus, systems, and methods cover all modifications, equivalents, and alternatives falling within the spirit and scope of the application as defined by the claims.

BRIEF DESCRIPTION OF THE DRAWINGS

The accompanying drawings, which are incorporated into and constitute a part of the specification, illustrate specific embodiments of the apparatus, systems, and methods and, together with the general description given above, and the detailed description of the specific embodiments, serve to explain the principles of the apparatus, systems, and methods.

DETAILED DESCRIPTION OF SPECIFIC EMBODIMENTS

Figure 1:
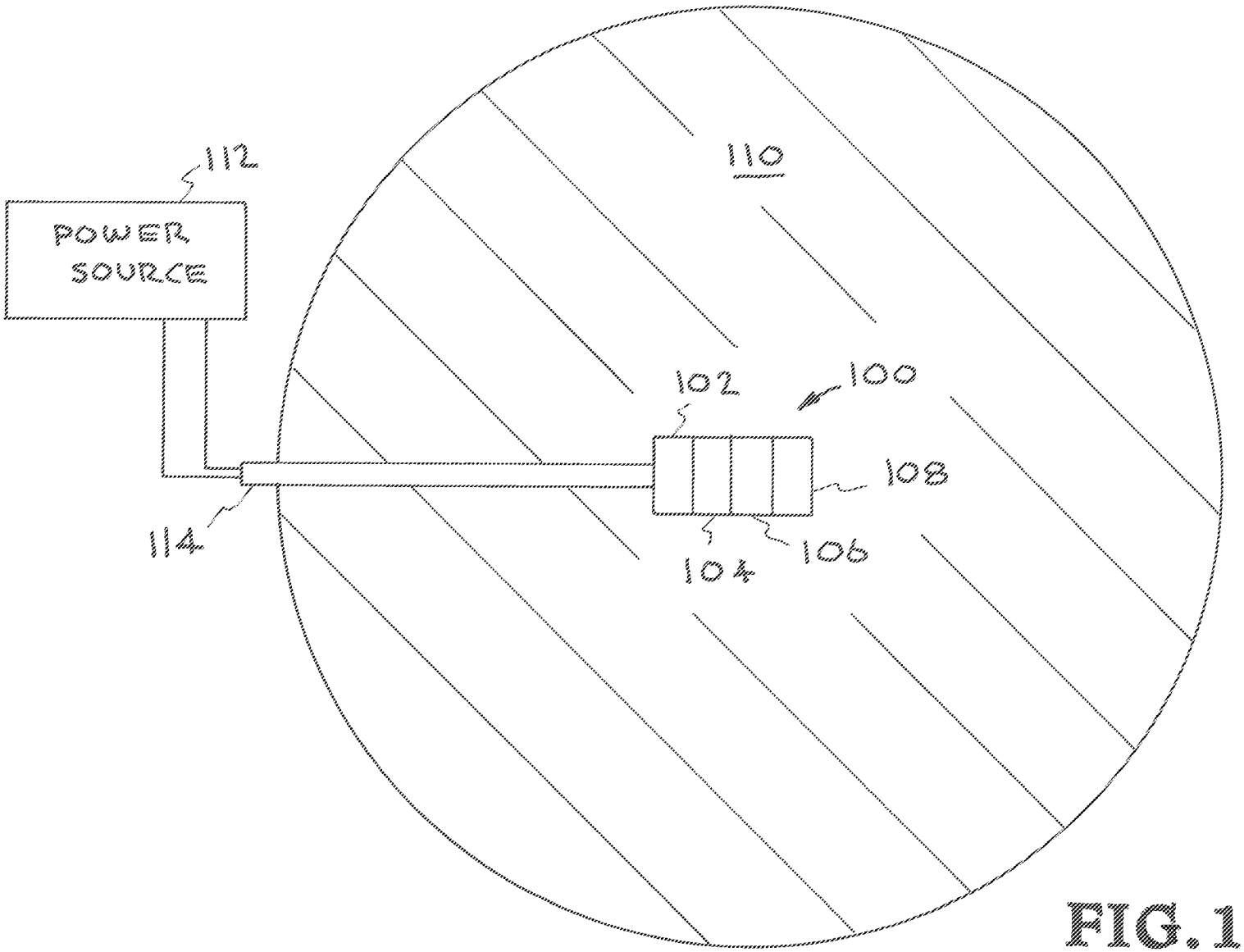
FIG. 1 illustrates one embodiment of the inventor's apparatus, systems, and methods.

Referring to the drawings, to the following detailed description, and to incorporated materials, detailed information about the apparatus, systems, and methods is provided including the description of specific embodiments. The detailed description serves to explain the principles of the apparatus, systems, and methods. The apparatus, systems, and methods are susceptible to modifications and alternative forms. The application is not limited to the particular forms disclosed. The application covers all modifications, equivalents, and alternatives falling within the spirit and scope of the apparatus, systems, and methods as defined by the claims.

Referring now to the drawings, and in particular to FIG. 1, an example embodiment of the inventor's apparatus, systems, and methods is illustrated. This embodiment of an opto-thermal laser detonator is designated generally by the reference numeral 100. The opto-thermal laser detonator 100 uses resonantly absorptive tuned nano-material associated with secondary explosives for optical absorption and initiation by an integral laser diode. The opto-thermal laser detonator 100 includes the components listed below.

Component 102—laser diode,
Component 104—grin lens,
Component 106—nanoresonant/explosive pellet,
Component 108—output pellet,
Component 110—reactive material,
Component 112—power source, and
Component 114—shielded leads.

The opto-thermal laser detonator 100 provides an optical laser detonator that is filled with a mixture of optically resonant nanometer sized dielectric spheres overcoated with a metal gold shell (nanoshells) or of tiny 30-nm gold nanorods into standard secondary explosives at a density of several hundred billion nanoshells or nanorods per gram of explosive to exponentially increase the optical absorption of laser energy at specific laser wavelengths to facilitate rapidly healing the explosive to a temperature where it deflagrates and transitions into a detonation. This mixture of nanoresonant material and explosive when hit with laser radiation focused by the integral laser diode input window upon a critical volume of explosive causes plasmonically resonant free electron motion in each gold metal nanoparticle that heats the nanoparticle until the volume melts and assumes a new shape, typically at temperatures>500 degrees Celsius in timescales from milliseconds to microseconds depending upon the laser intensity.

The components of the opto-thermal laser detonator 100 having been explained, the operation of the opto-thermal laser detonator 100 will now be described. The main explosive material 110 is provided. The resonantly absorptive tuned nano-material is associated with the secondary explosive material providing associated material 106. The associated material 106 is positioned in the main explosive material 110. The laser diode 102 is located in the main explosive material 110. The lens 104 receives the laser radiation and projects the laser radiation to the associated material 106. The output pellet 108 is located proximate the associated material 106. The main explosive material 110 is initiated using the laser diode 102 and the lens 104 and the associated material 106 that direct the output pellet 108 to initiate the main explosive material 110.

The nanoshells or nanorods are distributed throughout the volume of explosive at a density of several hundred billion of resonant nanoparticles per gram, this heat is uniformly distributed in the nanoparticle-seeded explosive mixture and the explosive starts a rapid deflagration that transitions into a detonation. The nanoshells have an internal dielectric-metal interface at the silica-gold interface that has plasmon wavelength that can be tuned into resonance at a particular laser wavelength by selecting the ratio of the diameter of the dielectric sphere to that of the metal shell thickness whereupon the surface Plasmon has a wavelength that is an integral ratio to the circumference of the dielectric sphere for a classic dipole MIE resonance. Likewise, in the incarnation of a nanorod resonant nanomaterial the ratio of the diameter of the rod to the length of the rod is controlled such that a plasmon dipole resonance is formed with long axis of the nanorod. At peak resonance, the plasmon wavelength sets up an oscillating electric field that has a dipole or quadrapole mie sphere resonance for nanoshells or a dipole resonance for nanorods where electrons are accelerated in the electric field from the north pole of the gold shell to the south pole of the gold shell in time with the reversal of the incident tuned laser frequency.

The multiple collisions of the oscillating free electrons travelling ballistically in the gold nanoparticle from the incident laser electromagnetic field cause ohmic heating that continues until the gold nanoparticle reaches its melting point and melts into a spherical globule, altering the surface plasmon resonance condition at the dielectric metal interface. The heating of the hundreds of billions of nanoshells per gram of explosive material quickly conducts to the surrounding matrix of secondary explosive heating it to the exothermal runaway condition that marks the beginning of deflagration.

Because of the ballistic electron transport in nanoparticles, the timescale of the heating can occur much faster than the nanoparticle can physical move from the original resonant dimension into a spherical globule from surface tension of the molten metal, and therefore overshoot the melting temperature for gold in terms of maximum temperatures reached. The billions of hot melting nanoparticles act as 'hot spots' that work to aid the transition of the explosive deflagration into a detonation moderated by both the laser peak power and the nanoshell density in the explosive. Large enough fluencies and peak laser power at specifically high nanoshell densities will cause a volumetric transition within the laser illuminated volume to detonation almost instantaneously. The tuned resonant property of the laser to the nanoshell makes it more effective at a specified design wavelength and laser fluence than any non-resonant carbon black absorber or any absorbing dye that can photo saturate and at much lower concentrations than these materials.

This electrically safe lower-energy laser detonator for the prompt deflagration-to-detonation initiation of an explosive train using an integral laser diode that is driven by a defined current pulse for a specific duration—still consumes only watts of energy for a duration of 100s of microseconds to several milliseconds. Embedded within the initial charge of the explosive is an explosive such as KETO RDX (K-6), Hexogen, RDX, PentaErythritol TetraNitrate (PETN), CL-20, and RS1-007, etc. that is associated with a matrix of resonant nanoshell or nanorod material capable of heating the explosive extremely rapidly beyond the exothermic runaway temperature upon exposure to a specific tuned laser wavelength. This light is emitted by an integral laser diode that will heat the sample to hundreds of degrees (Celsius) within microseconds to milliseconds and initiate a deflagration that will transition to a detonation within a few millimeters microseconds. An output pellet of RDX or HMX will be in contact with this nanoshell or nanorod doped initial pressing or pressed nanoresonant/explosive pellet to provide a repeatable high explosive output as in a normal detonator. The stimulation for detonation is only via an electrical pulse at the Input of the Integral laser diode which operates at a defined wavelength, for a defined current level and defined duration. The nanoresonant/explosive mixture can range from a lightly pressed powder that thermally heats up to deflagration at low laser power levels to a pressed pellet at near bulk density that almost instantaneously proceeds to detonation upon high laser power excitation. The integral laser diode is focused by an internal ball or GRIN lens upon a critical volume of nanoresonant/explosive that dissipates enough energy in both deflagration and detonation to transition from a self-sustaining chemical reaction either deflagrating into a detonation transition.

The unique safety aspect of this type of detonator is that it requires a sustained current pulse and length and cannot Initial from a simple static discharge from a person or a charged piece of equipment. The use of secondary explosives makes this type of detonator safer than a traditional blasting cap that is very static sensitive and contains lead azide, lead styphnate or a mixture of the two. The integral laser diode is approximately a half-watt to a watt type output power at either 810-nm or 975-nm and is very low cost in volume such as those used in green laser pointers. The device isolates the secondary explosive from the electrical leads of the laser diode by an optical window and focusing lens to further protect the HE from any electrostatic Initiation and the HE charge is confined in a faraday cage. This diode meets a market need for a safe alternative to a blasting cap without the peak power required of an exploding bridgewire detonator or slapper detonator.

The present invention is further described and illustrated by a number of examples of apparatus, systems, and methods constructed in accordance with the present invention. Various changes and modifications of these examples will be apparent to those skilled in the art from the description of the examples and by practice of the invention. The scope of the invention is not intended to be limited to the particular examples disclosed and the invention covers all modifications, equivalents, and alternatives falling within the spirit and scope of the invention as defined by the claims.

EXAMPLE 1

Embodiment with Gold Nanospheres

Figure 2:
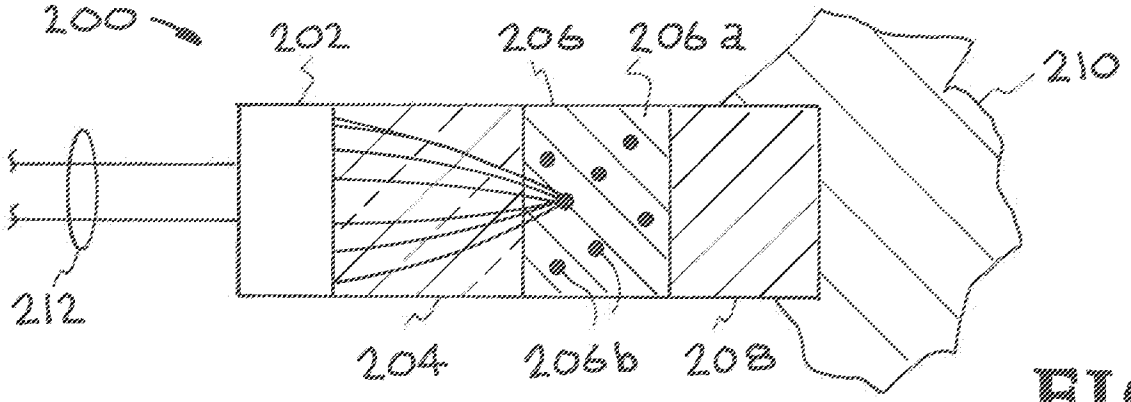
FIG. 2 illustrates a first example embodiment of the inventor's apparatus, systems, and methods.

Referring now to FIG. 2, a first example embodiment of the inventor's apparatus, systems, and methods is illustrated. This first example embodiment is designated generally by the reference numeral 200. The opto-thermal laser detonator 200 uses resonantly absorptive tuned nano-material associated with secondary explosives for optical absorption and initiation by an integral laser diode. The opto-thermal laser detonator 200 includes the components listed below.

Component 202—laser diode,
Component 204—grin lens,
Component 206—pellet with nanoresonant/explosive,
Component 208—output pellet,
Component 210—reactive material, and
Component 212—shielded leads to power source.

The opto-thermal laser detonator 200 provides an optical laser detonator that is filled with a combination 206 of a standard secondary explosives material 206*a* and nanoresonant particles 206*b*. The nanoresonant particles 206*b* exponentially increase the optical absorption of laser energy at specific laser wavelengths to facilitate rapidly healing the explosive 206*a* to a temperature where it deflagrates and transitions into a detonation. This mixture 206*a* of nanoresonant material and explosive when hit with laser radiation focused by the integral laser diode input window upon a critical volume of explosive causes resonant free electron motion in each gold metal nanoparticle that heats the nanoparticle until the volume melts and assumes a new shape, typically at temperatures>100 degrees Celsius in timescales from milliseconds to microseconds depending upon the laser intensity. In this example 1 embodiment the nanoresonant particles 206*b* are gold nanospheres. The gold nanospheres 206*b* are optically resonant nanometer sized dielectric spheres overcoated with a metal gold shell (nanoshells) or hollow gold nanoshells (HGNs).

The components of the opto-thermal laser detonator 200 having been explained, the operation of the opto-thermal laser detonator 200 will now be described. The main explosive material 210 is provided. The resonantly absorptive tuned nano-material 206*b* is associated with the secondary explosive material 206*a* providing associated material 206. The associated material 206 is positioned in the main explosive material 210. The laser diode 202 is located in the main explosive material 210. The GRIN lens 204 receives the laser radiation and projects the laser radiation to the associated material 206. The output pellet 208 is located proximate the associated material 206. The main explosive material 210 is initiated using the laser diode 202 and the lens 204 and the associated material 206 that direct the output pellet 208 to initiate the main explosive material 210.

EXAMPLE 2

Embodiment with Gold Nanorods

Referring again to FIG. 2, a second example embodiment of the inventor's apparatus, systems, and methods is illustrated. This second example of an opto-thermal laser detonator 200 uses resonantly absorptive tuned nano-material associated with secondary explosives for optical absorption and initiation by an integral laser diode. The opto-thermal laser detonator 200 includes the components listed below.

Component 202—laser diode,
Component 204—grin lens,
Component 206—pellet with nanoresonant/explosive,
Component 208—output pellet,
Component 210—reactive material, and
Component 212—shielded leads to power source.

The opto-thermal laser detonator 200 provides an optical laser detonator that is filled with a combination 206 of a standard secondary explosives material 206*a* and nanoresonant particles 206*b*. The nanoresonant particles 206*b* exponentially increase the optical absorption of laser energy at specific laser wavelengths to facilitate rapidly healing the explosive 206*a* to a temperature where it deflagrates and transitions into a detonation. This mixture 206*a* of nanoresonant material and explosive when hit with laser radiation focused by the integral laser diode input window upon a critical volume of explosive causes resonant free electron motion in each gold metal nanoparticle that heats the nanoparticle until the volume melts and assumes a new shape, typically at temperatures>500 degrees Celsius in timescales from milliseconds to microseconds depending upon the laser intensity. In this example 2 embodiment the nanoresonant particles 206*b* are gold nanorods. The gold nanorods 206*b* are tiny 30-nm gold nanorods.

The components of the opto-thermal laser detonator 200 having been explained, the operation of the opto-thermal laser detonator 200 will now be described. The main explosive material 210 is provided. The resonantly absorptive tuned nano-material 206*b* is associated with the secondary explosive material 206*a* providing associated material 206. The associated material 206 is positioned in the main explosive material 210. The laser diode 202 is located in the main explosive material 210. The GRIN lens 204 receives the laser radiation and projects the laser radiation to the associated material 206. The output pellet 208 is located proximate the associated material 206. The main explosive material 210 is initiated using the laser diode 202 and the lens 204 and the associated material 206 that direct the output pellet 208 to initiate the main explosive material 210.

EXAMPLE 3

Embodiment with Ball Lens

Figure 3:
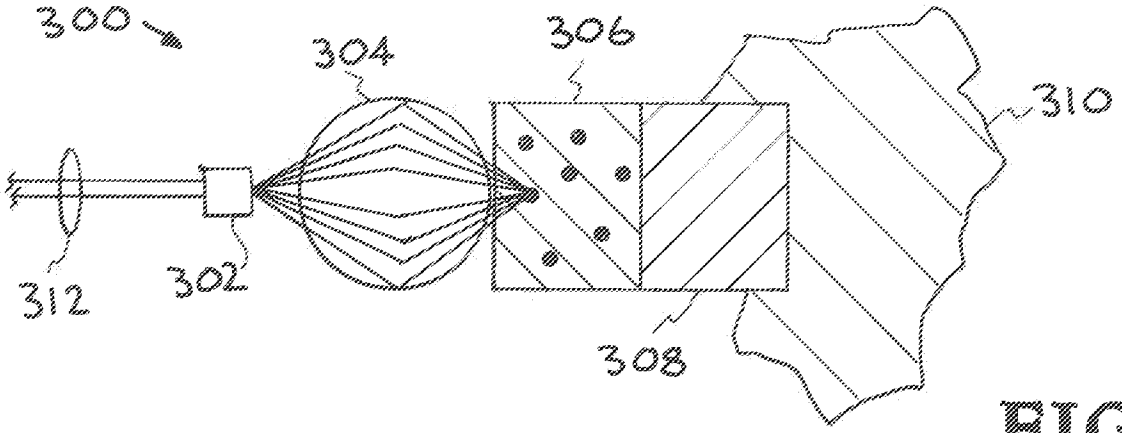
FIG. 3 illustrates an embodiment of the inventor's apparatus, systems, and methods using a ball lens.

Referring now to FIG. 3, a third example embodiment of the inventor's apparatus, systems, and methods is illustrated. This third example of an opto-thermal laser detonator 300 uses resonantly absorptive tuned nano-material associated with secondary explosives for optical absorption and initiation by an integral laser diode. The opto-thermal laser detonator 300 includes the components listed below.

Component 302—laser diode,
Component 304—ball lens,
Component 306—pellet with nanoresonant/explosive,
Component 308—output pellet,
Component 310—reactive material, and
Component 312—shielded leads to power source.

The opto-thermal laser detonator 300 provides an optical laser detonator that is filled with a combination 306 of a standard secondary explosives material and nanoresonant particles. The nanoresonant particles exponentially increase the optical absorption of laser energy at specific laser wavelengths to facilitate rapidly healing the explosive to a temperature where it deflagrates and transitions into a detonation. This mixture 306 of nanoresonant material and explosive when hit with laser radiation focused by the integral laser diode input window upon a critical volume of explosive causes resonant free electron motion in each gold metal nanoparticle that heats the nanoparticle until the volume melts and assumes a new shape, typically at temperatures>100 degrees Celsius in timescales from milliseconds to microseconds depending upon the laser intensity.

The components of the opto-thermal laser detonator 300 having been explained, the operation of the opto-thermal laser detonator 300 will now be described. The main explosive material 310 is provided. The associated material 306 is positioned in the main explosive material 310. The laser diode 302 is located in the main explosive material 310. The BALL lens 304 receives the laser radiation and projects the laser radiation to the associated material 306. The output pellet 308 is located proximate the associated material 306. The main explosive material 310 is initiated using the laser diode 302 and the BALL lens 304 and the associated material 306 that direct the output pellet 308 to initiate the main explosive material 310.

EXAMPLE 4

Embodiment with Lightly Pressed Powder

Figure 4:
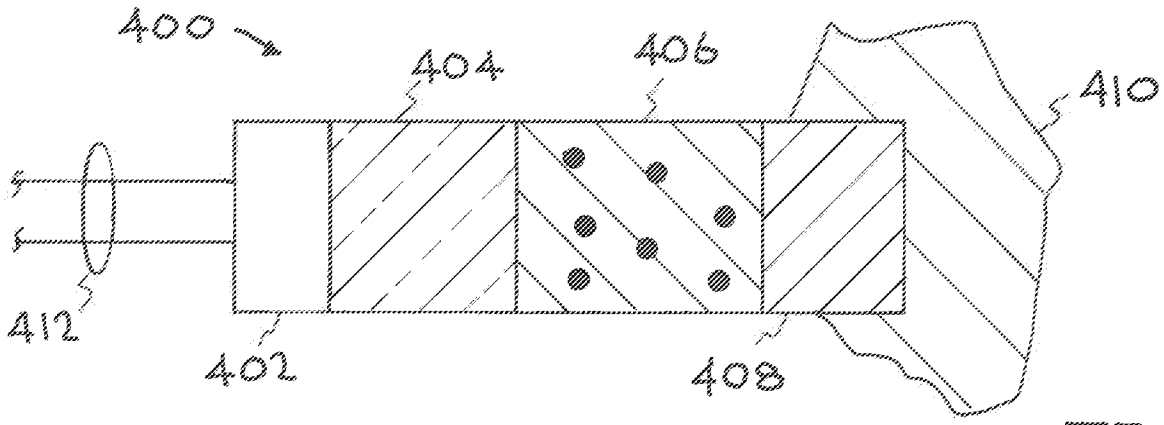
FIG. 4 illustrates an embodiment of the inventor's apparatus, systems, and methods wherein the resonantly absorptive tuned nano-material is lightly packed.

Referring now to FIG. 4, a fourth example embodiment of the inventor's apparatus, systems, and methods is illustrated. This fourth example of an opto-thermal laser detonator 400 uses resonantly absorptive tuned nano-material associated with secondary explosives for optical absorption and initiation by an integral laser diode. The opto-thermal laser detonator 400 includes the components listed below.

Component 402—laser diode,

Component 404—lens,

Component 406—pellet with nanoresonant/explosive (lightly pressed powder),

Component 408—output pellet,

Component 410—reactive material, and

Component 412—shielded leads to power source.

The opto-thermal laser detonator 400 provides an optical laser detonator that is filled with a combination 406 of a standard secondary explosives material and nanoresonant particles in the form of a lightly pressed powder. The nanoresonant particles exponentially increase the optical absorption of laser energy at specific laser wavelengths to facilitate rapidly healing the explosive to a temperature where it deflagrates and transitions into a detonation. This mixture 406 of nanoresonant material and explosive when hit with laser radiation focused by the integral laser diode input window upon a critical volume of explosive causes resonant free electron motion in each gold metal nanoparticle that heats the nanoparticle until the volume melts and assumes a new shape, typically at temperatures>500 degrees Celsius in timescales from milliseconds to microseconds depending upon the laser intensity.

The components of the opto-thermal laser detonator 400 having been explained, the operation of the opto-thermal laser detonator 400 will now be described. The main explosive material 410 is provided. The associated material 406 is a lightly pressed powder that thermally heats up to deflagration at low laser power levels. The associated material 406 is positioned in the main explosive material 410. The laser diode 402 is located in the main explosive material 410. The lens 404 receives the laser radiation and projects the laser radiation to the associated material 406. The output pellet 408 is located proximate the associated material 406. The main explosive material 410 is initiated using the laser diode 402 and the lens 404 and the associated material 406 that direct the output pellet 408 to initiate the main explosive material 410.

EXAMPLE 5

Embodiment with Pressed Pellet at Near Bulk Density

Figure 5:
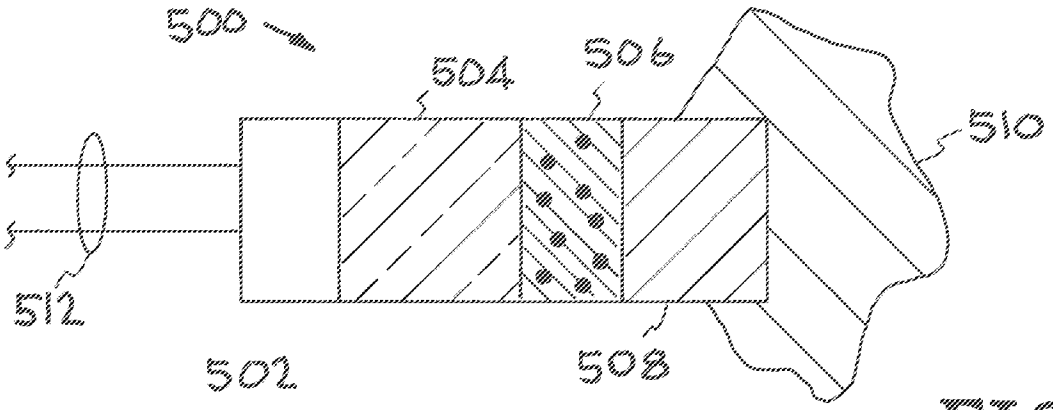
FIG. 5 illustrates an embodiment of the inventor's apparatus, systems, and methods wherein the resonantly absorptive tuned nano-material is dense pressed powder.

Referring now to FIG. 5, a fifth example embodiment of the inventor's apparatus, systems, and methods is illustrated. This fifth example of an opto-thermal laser detonator 500 uses resonantly absorptive tuned nano-material associated with secondary explosives for optical absorption and initiation by an integral laser diode. The opto-thermal laser detonator 500 includes the components listed below.

Component 502—laser diode,

Component 504—lens,

Component 506—pellet with nanoresonant/explosive (near bulk density),

Component 508—output pellet,

Component 510—reactive material, and

Component 512—shielded leads to power source.

The opto-thermal laser detonator 500 provides an optical laser detonator that is filled with a combination 506 of a standard secondary explosives material and nanoresonant particles in the form of a pressed pellet at near bulk density that almost instantaneously proceeds to detonation upon high laser power excitation. The nanoresonant particles exponentially increase the optical absorption of laser energy at specific laser wavelengths to facilitate rapidly healing the explosive to a temperature where it deflagrates and transitions into a detonation. This mixture 506 of nanoresonant material and explosive when hit with laser radiation focused by the integral laser diode input window upon a critical volume of explosive causes resonant free electron motion in each gold metal nanoparticle that heats the nanoparticle until the volume melts and assumes a new shape, typically at temperatures>500 degrees Celsius in timescales from milliseconds to microseconds depending upon the laser intensity.

The components of the opto-thermal laser detonator 500 having been explained, the operation of the opto-thermal laser detonator 500 will now be described. The main explosive material 510 is provided. The associated material 506 is a pressed pellet at near bulk density that almost instantaneously proceeds to detonation upon high laser power excitation. The associated material 506 is positioned in the main explosive material 510. The laser diode 502 is located in the main explosive material 510. The lens 504 receives the laser radiation and projects the laser radiation to the associated material 506. The output pellet 508 is located proximate the associated material 506. The main explosive material 510 is initiated using the laser diode 502 and the lens 504 and the associated material 506 that direct the output pellet 508 to initiate the main explosive material 510.

EXAMPLE 6

Electrically Safe Low Energy Laser Detonator Embodiment

Figure 6:
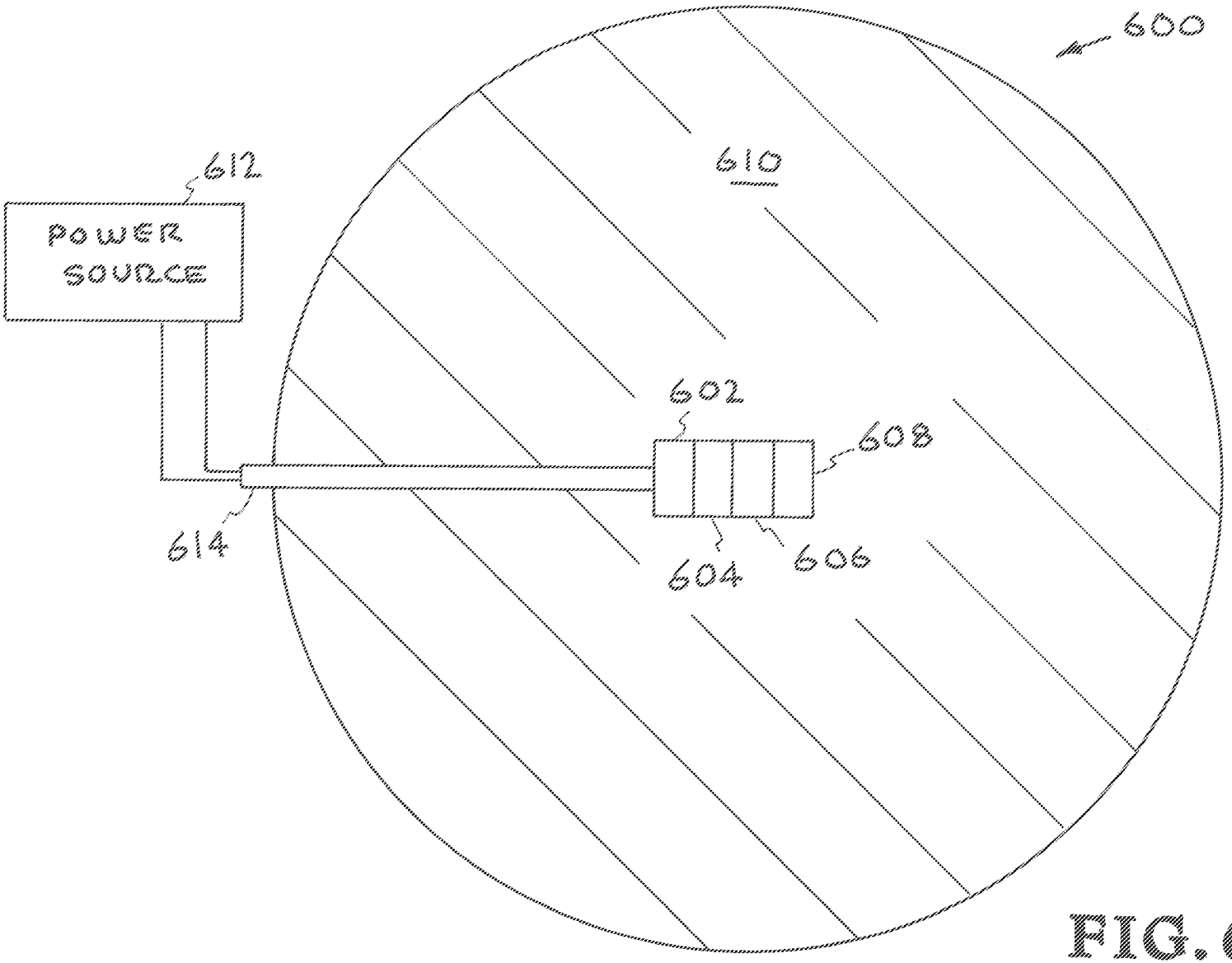
FIG. 6 illustrates another embodiment of the inventor's apparatus, systems, and methods using a low power diode laser.

Referring now to FIG. 6, a sixth example embodiment of the inventor's apparatus, systems, and methods is illustrated. This sixth example of an opto-thermal laser detonator 600 uses resonantly absorptive tuned nano-material associated with secondary explosives for optical absorption and initiation by an electrically safe low energy integral laser diode. The opto-thermal laser detonator 600 includes the components listed below.

Component 602—electrically safe low energy laser diode,
Component 604—lens,
Component 606—pellet with nanoresonant/explosive,
Component 608—output pellet,
Component 610—reactive material, and
Component 612—low power source (less than a half-watt to a watt type output power).

The opto-thermal laser detonator 600 provides an optical laser detonator that is filled with a combination 606 of a standard secondary explosives material and nanoresonant particles. The nanoresonant particles exponentially increase the optical absorption of laser energy at specific laser wavelengths to facilitate rapidly healing the explosive to a temperature where it deflagrates and transitions into a detonation. This mixture 606 of nanoresonant material and explosive when hit with laser radiation focused by the electrically safe low energy laser diode 602 input window upon a critical volume of explosive causes resonant free electron motion in each gold metal nanoparticle that heats the nanoparticle until the volume melts and assumes a new shape, typically at temperatures>500 degrees Celsius in timescales from milliseconds to microseconds depending upon the laser intensity.

The components of the opto-thermal laser detonator 600 having been explained, the operation of the opto-thermal laser detonator 600 will now be described. The main explosive material 610 is provided. The associated material 606 is a pressed pellet at near bulk density that almost instantaneously proceeds to detonation upon high laser power excitation. The associated material 606 is positioned in the main explosive material 610. The laser diode 602 is located in the main explosive material 610. The lens 604 receives the laser radiation and projects the laser radiation to the associated material 606. The output pellet 608 is located proximate the associated material 606. The main explosive material 610 is initiated using the electrically safe low energy laser diode 602 and the lens 604 and the associated material 606 that direct the output pellet 608 to initiate the main explosive material 610. The unique safety aspect of this type of detonator is that it requires a sustained current pulse and length and cannot initial from a simple static discharge from a person or a charged piece of equipment. The electrically safe low energy laser diode 602 uses less than a half-watt to a watt type output power at either 810-nm or 975-nm and is very low cost in volume such as those used in green laser pointers.

Although the description above contains many details and specifics, these should not be construed as limiting the scope of the application but as merely providing illustrations of some of the presently preferred embodiments of the apparatus, systems, and methods. Other implementations, enhancements and variations can be made based on what is described and illustrated in this patent document. The features of the embodiments described herein may be combined in all possible combinations of methods, apparatus, modules, systems, and computer program products. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Therefore, it will be appreciated that the scope of the present application fully encompasses other embodiments which may become obvious to those skilled in the art. In the claims, reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present apparatus, systems, and methods, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

While the apparatus, systems, and methods may be susceptible to various modifications and alternative forms, specific embodiments have been shown by way of example in the drawings and have been described in detail herein. However, it should be understood that the application is not intended to be limited to the particular forms disclosed. Rather, the application is to cover all modifications, equivalents, and alternatives falling within the spirit and scope of the application as defined by the following appended claims.

The invention claimed is:

1. An opto-thermal laser detonation method, comprising the steps of:

providing main explosive material;
providing resonantly absorptive tuned nano-material;
providing secondary explosive material;
associating said resonantly absorptive tuned nano-material with said secondary explosive material providing associated material made of said resonantly absorptive tuned nano-material and said secondary explosive material;
positioning said associated material in said main explosive material;
providing an output pellet;
providing a laser diode that produces laser radiation;
locating said laser diode in said explosive material and in said associated material, positioning said lens to receive said laser radiation and project said laser radiation to said associated material,
positioning said output pellet proximate said associated material; and
initiating said main explosive material using said laser diode and said lens and said associated material and said output pellet.

2. The opto-thermal laser detonation method of claim 1 wherein said step of providing resonantly absorptive tuned nano-material comprises providing optically resonant nanometer sized dielectric spheres overcoated with a metal gold shell.

3. The opto-thermal laser detonation method of claim 1 wherein said step of providing resonantly absorptive tuned nano-material comprises providing optically resonant nanometer sized dielectric spheres overcoated with a metal gold shell.

4. The opto-thermal laser detonation method of claim 1 wherein said step of providing secondary explosive material comprises providing KETO RDX (K-6), Hexogen, RDX, PentaErythritol TetraNitrate (PETN), CL-20, or RS1-007 secondary explosive material.

* * * * *